US011683867B2

(12) United States Patent
Oomori et al.

(10) Patent No.: US 11,683,867 B2
(45) Date of Patent: Jun. 20, 2023

(54) MICROWAVE TREATMENT DEVICE

(71) Applicant: Panasonic Intellectual Property Management Co., Ltd., Osaka (JP)

(72) Inventors: Yoshiharu Oomori, Shiga (JP); Mikio Fukui, Shiga (JP); Daisuke Hosokawa, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 455 days.

(21) Appl. No.: 17/052,968

(22) PCT Filed: May 15, 2019

(86) PCT No.: PCT/JP2019/019200
§ 371 (c)(1),
(2) Date: Nov. 4, 2020

(87) PCT Pub. No.: WO2019/225412
PCT Pub. Date: Nov. 28, 2019

(65) Prior Publication Data

US 2021/0352777 A1 Nov. 11, 2021

(30) Foreign Application Priority Data

May 21, 2018 (JP) ..... JP2018-096702
May 21, 2018 (JP) ..... JP2018-096703

(51) Int. Cl.
*H05B 6/68* (2006.01)
*H05B 6/70* (2006.01)
*H05B 6/72* (2006.01)

(52) U.S. Cl.
CPC ..... *H05B 6/68* (2013.01); *H05B 6/70* (2013.01); *H05B 6/72* (2013.01)

(58) Field of Classification Search
CPC ..... H05B 6/68; H05B 6/70; H05B 6/72; H05B 6/66; H05B 6/80; G06F 21/32;
(Continued)

(56) References Cited

U.S. PATENT DOCUMENTS

2010/0176121 A1 7/2010 Nobue et al.
2010/0176123 A1* 7/2010 Mihara ..... H05B 6/705 219/746

FOREIGN PATENT DOCUMENTS

JP 2004-047322 2/2004
JP 2008-066292 3/2008

OTHER PUBLICATIONS

International Search Report of PCT application No. PCT/JP2019/019200 dated Jul. 16, 2019.

* cited by examiner

*Primary Examiner* — Quang T Van
(74) *Attorney, Agent, or Firm* — McDermott Will & Emery LLP

(57) ABSTRACT

A microwave treatment device includes a plurality of radiation parts, a transmission line, and a plurality of feeding parts. The plurality of radiation parts includes first, second, and third radiation parts, and radiates a microwave. The transmission line has a loop line structure provided with a plurality of branch parts including first, second, and third branch parts, and transmits the microwave to the first, second, and third radiation parts respectively connected to the first, second, and third branch parts. The plurality of feeding parts includes the first feeding part and the second feeding part arranged in the transmission line at an interval of ¼ or less of the wavelength of the microwave, and transmits the microwave to the transmission line. According to this aspect, a radiation part that radiates the microwave
(Continued)

can be selectively switched. This enables the intended heating distribution to be achieved.

11 Claims, 5 Drawing Sheets

(58) Field of Classification Search
CPC ..... G06V 10/20; G06V 10/993; G06V 40/1365; G06V 40/14; G06V 40/15; G06V 40/172; G06V 40/197; G06V 40/70; H04L 63/0861; H04M 1/72463; H04M 1/725; H04W 12/06
USPC ..... 219/702, 660, 690, 716, 746, 748, 749, 219/754, 756, 757, 761, 762, 763; 426/107, 234, 241, 243, 395
See application file for complete search history.

MICROWAVE TREATMENT DEVICE

CROSS-REFERENCE OF RELATED APPLICATIONS

This application is the U.S. National Phase under 35 U.S.C. § 371 of International Patent Application No. PCT/JP2019/019200, filed on May 15, 2019, which in turn claims the benefit of Japanese Application No. 2018-096703, filed on May 21, 2018 and Japanese Application No. 2018-096702, filed on May 21, 2018, the entire disclosures of which Applications are incorporated by reference herein.

TECHNICAL FIELD

The present disclosure relates to a microwave treatment device for heating a heating target object accommodated in a heating chamber.

BACKGROUND ART

Conventionally, microwave treatment devices include those equipped with a plurality of rotation antennas (see, for example, PTL 1). A microwave treatment device described in PTL 1 aims to reduce uneven heating by radiating microwaves to a wide area inside a heating chamber by means of a plurality of rotation antennas.

Conventional technologies include a microwave treatment device including a plurality of radiation parts radiating microwaves and configured to control a phase difference of the microwaves radiated from the plurality of radiation parts (see, for example, PTL 2). The microwave treatment device described in PTL 2 aims to change microwave distribution by controlling a phase difference, thus performing uniform heating and intensive heating.

CITATION LIST

Patent Literature

PTL 1: Japanese Patent Application Unexamined Publication No. 2004-47322

PTL 2: Japanese Patent Application Unexamined Publication No. 2008-66292

SUMMARY OF THE INVENTION

However, with the microwave treatment device described in PTL 1, the microwave distribution does not much vary. With the microwave treatment device described in PTL 2, it is difficult to carry out desired heat treatment on objects to be heated having various shapes, types, and amounts.

That is to say, even if a phase difference is controlled, a standing wave moves only by about half a wavelength, and the microwave distribution does not much vary. Even if a plurality of microwaves are spatially synthesized to control the microwave distribution in a heating chamber, the microwave distribution itself changes due to an influence of the heating target object. Consequently, the intended heating cannot be reproduced. When a plurality of radiation parts is operated or stopped, radiation positions are largely displaced, thus enabling the microwave distribution to largely vary. However, supplied electric power becomes smaller, and cooking time becomes longer.

The present disclosure has been made in view of the above-mentioned problems. An object of the present disclosure is to provide a microwave treatment device capable of heating objects to be heated having various shapes, types, and amounts into a desired state for a short time.

A microwave treatment device in accordance with one aspect of the present disclosure includes a plurality of radiation parts, a transmission line, and a plurality of feeding parts. The plurality of radiation parts includes a first radiation part, a second radiation part, and a third radiation part, and radiates a microwave. The transmission line has a loop line structure provided with a plurality of branch parts including a first branch part, a second branch part, and a third branch part. The transmission line transmits the microwave to the first radiation part, the second radiation part, and the third radiation part respectively connected to the first branch part, the second branch part, and the third branch part. The plurality of feeding parts includes the first feeding part and the second feeding part arranged in the transmission line at an interval of ¼ or less of a wavelength of the microwave, and transmits the microwave to the transmission line.

According to this aspect, a radiation part that radiates the microwave can be selectively switched. This enables the intended heating distribution to be achieved. As a result, objects to be heated having various shapes, types, and amounts can be heated into a desired state for a short time.

DESCRIPTION OF EMBODIMENTS

Figure 1:
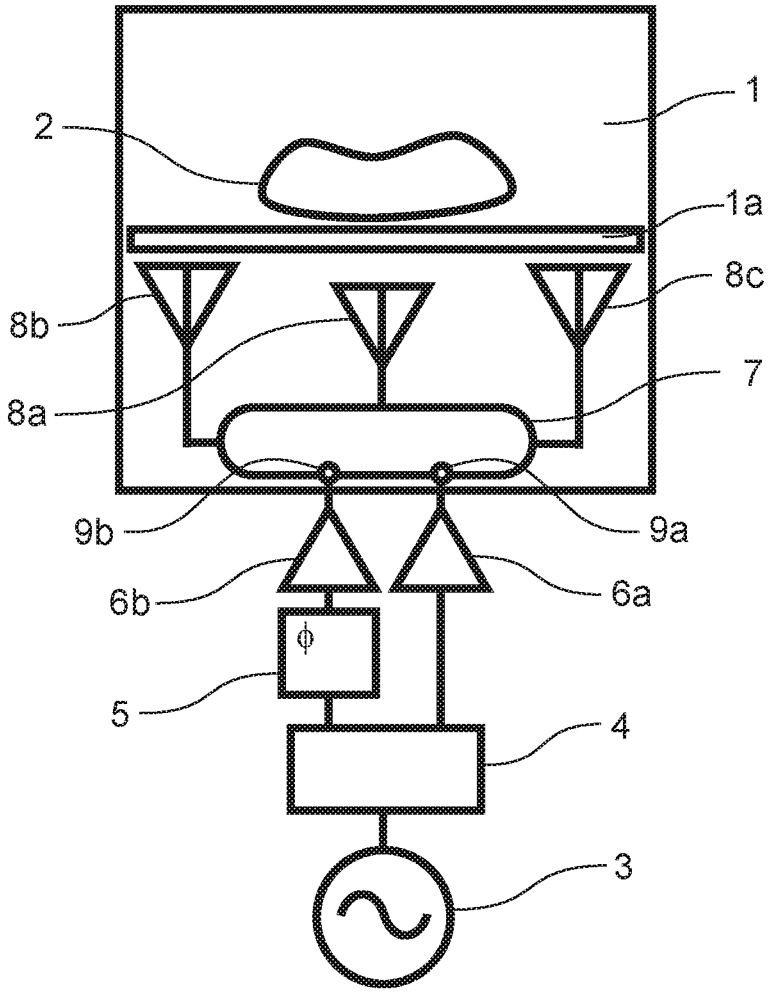
FIG. 1 is a schematic diagram showing a configuration of a microwave treatment device in accordance with a first exemplary embodiment of the present disclosure.

A microwave treatment device of a first aspect of the present disclosure includes a plurality of radiation parts, a transmission line, and a plurality of feeding parts. The plurality of radiation parts includes a first radiation part, a second radiation part, and a third radiation part, and radiates a microwave. The transmission line has a loop line structure provided with a plurality of branch parts including a first branch part, a second branch part, and a third branch part. The transmission line transmits the microwave to the first radiation part, the second radiation part, and the third radiation part respectively connected to the first branch part, the second branch part, and the third branch part. The plurality of feeding parts includes a first feeding part and a second feeding part arranged in the transmission line at an interval of ¼ or less of a wavelength of the microwave, and transmits the microwave to the transmission line.

In the microwave treatment device of a second aspect of the present disclosure, in addition to the first aspect, the first branch part is arranged at an equal interval from the first feeding part and the second feeding part; and the second branch part and the third branch part are separately arranged apart at ¼ of the wavelength of the microwave from the first branch part.

In a microwave treatment device in accordance with a third aspect of the present disclosure, in addition to the first aspect, the first feeding part and the second feeding part transmit the microwave vertically with respect to the transmission line.

In a microwave treatment device in accordance with a fourth aspect of the present disclosure, a radiation part that radiates the microwave is selectively switched among the plurality of radiation parts by controlling a phase difference between the two microwaves supplied from the first feeding part and the second feeding part to the transmission line in the first aspect.

In a microwave treatment device in accordance with a fifth aspect of the present disclosure, in addition to the first aspect, the first feeding part and the second feeding part are arranged at an interval of ¼ of the wavelength of the microwave.

In a microwave treatment device in accordance with a sixth aspect of the present disclosure, in addition to the first aspect, a length of one circumference of the transmission line is set at a sum of an integral multiple of the wavelength of a microwave, a half of the wavelength of the microwave, and twice of the interval between the first feeding part and the second feeding part.

In a microwave treatment device in accordance with a seventh aspect of the present disclosure, in addition to the first aspect, the transmission line has an elliptical shape including a straight portion and a curved portion.

A microwave treatment device in accordance with an eighth aspect of the present disclosure includes a first feeding control circuit and a second feeding control circuit in addition to the first aspect. Each of the first feeding control circuit and the second feeding control circuit includes the plurality of feeding parts, the plurality of branch parts, the plurality of radiation parts, and the transmission line. The first radiation part included in the first feeding control circuit is common to the first radiation part included in the second feeding control circuit.

A microwave treatment device in accordance with a ninth aspect of the present disclosure, in addition to the eighth aspect, further includes a heating chamber for accommodating a heating target object. The first radiation part is disposed below a center portion of a mount table of the heating chamber.

In a microwave treatment device in accordance with a tenth aspect of the present disclosure, in addition to the eighth aspect, the first radiation part is a patch antenna, and the first feeding control circuit and the second feeding control circuit transmit the microwave vertically with respect to the first radiation part.

In a microwave treatment device in accordance with an eleventh aspect of the present disclosure, in addition to the first aspect, the second radiation part includes a plurality of radiation parts, and the third radiation part includes a plurality of radiation parts.

Hereinafter, the exemplary embodiment of the present disclosure is described with reference to drawings. In the description, the same reference marks are given to the same or corresponding parts, and duplicate description thereof are omitted.

First Exemplary Embodiment

FIG. 1 is a schematic diagram showing a configuration of microwave treatment device in accordance with a first exemplary embodiment of the present disclosure. As shown in FIG. 1, the microwave treatment device of this exemplary embodiment includes heating chamber 1, oscillation part 3, distributing part 4, phase variable part 5, amplifiers 6*a* and 6*b*, transmission line 7, and radiation parts 8*a*, 8*b*, and 8*c*.

Heating chamber 1 accommodates heating target object 2, for example, food. Oscillation part 3 includes, for example, an oscillation source formed of, for example, a semiconductor, and generates microwaves. Distributing part 4 distributes the microwaves generated by oscillation part 3 into two, and supplies the distributed microwaves to phase variable part 5 and amplifier 6*a*.

Phase variable part 5 changes the phase of the microwaves distributed by distributing part 4. Amplifier 6*a* amplifies the microwaves distributed by distributing part 4. Amplifier 6*b* amplifies the microwaves whose phase has been changed by phase variable part 5.

Feeding parts 9*a* and 9*b* are arranged in transmission line 7. The microwave amplified by amplifier 6*a* is transmitted to transmission line 7 via feeding part 9*a*. The microwave amplified by amplifier 6*b* is transmitted to transmission line 7 via feeding part 9*b*.

Radiation parts 8*a*, 8*b*, and 8*c* radiate the microwaves transmitted via transmission line 7 to the inside of heating chamber 1. Heating target object 2 inside heating chamber 1 is heated by the microwaves radiated by radiation parts 8*a*, 8*b*, and 8*c*.

Transmission line 7 and radiation parts 8*a*, 8*b*, and 8*c* are disposed below mount table 1*a* in heating chamber 1 in which heating target object 2 is mounted.

Radiation parts 8*a*, 8*b*, and 8*c* correspond to the first radiation part, the second radiation part, and the third radiation part, respectively. Feeding parts 9*a* and 9*b* correspond to the first feeding part and the second feeding part, respectively.

Figure 2:
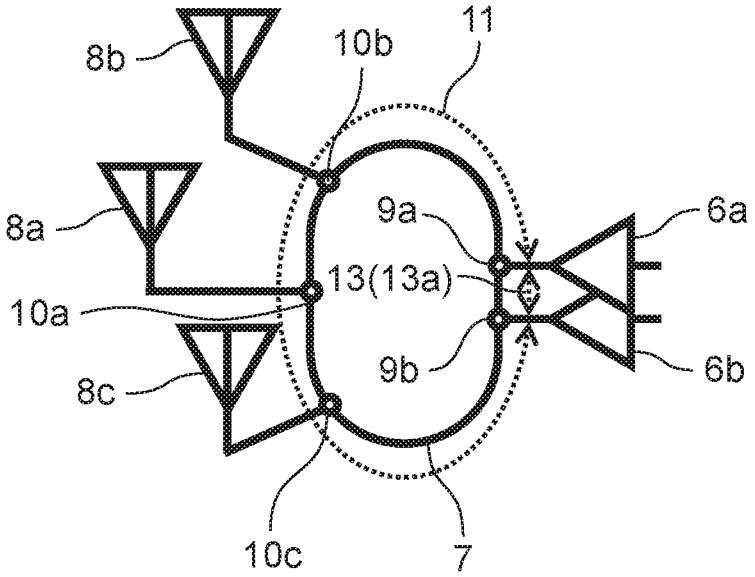
FIG. 2 is a schematic diagram showing a configuration and a line length of a transmission line in the microwave treatment device in accordance with the first exemplary embodiment.

FIG. 2 is a schematic diagram showing a configuration and a line length of transmission line 7 in the microwave treatment device in accordance with this exemplary embodiment. In particular, FIG. 2 shows a path length between feeding parts 9*a* and 9*b*. As shown in FIG. 2, transmission line 7 has an elliptical loop line structure including a straight portion and a curved portion. The straight portion of transmission line 7 is provided with branch parts 10*a*, 10*b*, and 10*c*.

The microwaves transmitted to transmission line 7 from feeding parts 9*a* and 9*b* are synthesized on transmission line 7. The microwaves synthesized on transmission line 7 are supplied to radiation parts 8*a*, 8*b*, and 8*c* via branch parts 10*a*, 10*b*, and 10*c*. Branch parts 10*a*, 10*b*, and 10*c* correspond to a first branch part, a second branch part, and a third branch part, respectively.

Feeding parts 9*a* and 9*b* are provided in adjacent to each other on the straight portion of transmission line 7. In this exemplary embodiment, feeding parts 9*a* and 9*b* are arranged at an interval of ¼ or less of the wavelength of the microwave. Feeding parts 9*a* and 9*b* transmit microwaves vertically with respect to transmission line 7. That is to say, transmission line 7 has a T-letter shaped coupled-line configuration. Thus, at feeding parts 9*a* and 9*b*, the microwaves are branched into two equally.

Operations and actions of the microwave treatment device configured as mentioned above are described.

As shown in FIG. 2, a path between feeding parts 9*a* and 9*b* on transmission line 7 includes path 11 that substantially circulates transmission line 7, and path 13 linking feeding parts 9*a* and 9*b* at the shortest distance.

When the length of path 13, that is, the interval between feeding part 9*a* and feeding part 9*b* is defined as a [mm] (α is ¼ or less of the wavelength of the microwave), the length of path 11 is set at the sum [mm] of an integral multiple of the wavelength of the microwave, a half of the wavelength of the microwave, and a. That is to say, the length of one circumference of transmission line 7 is the sum of the integral multiple of the wavelength of the microwave, a half of the wavelength of the microwave, and twice of the interval between feeding parts 9*a* and 9*b*.

Since paths 11 and 13 have the above lengths, two microwaves which have propagated on two paths from feeding part 9*a* are synthesized in opposite phase at feeding part 9*b*, and cancel each other (see Table 1). As a result, penetration of the microwaves from feeding part 9*a* to feeding part 9*b* can be suppressed. Similarly, penetration of the microwaves from feeding part 9*b* to feeding part 9*a* can also be suppressed.

TABLE 1

| From feeding part 9a to feeding part 9b | Via path 11 | Via path 13 | Synthesizing result |
|---|---|---|---|
| Path length | Wavelength of microwave X *n* (n: integer) + Wavelength of microwave X 1/2 + α [mm] | α [mm] | Cancel |

In this way, since the penetration of the microwaves between feeding parts 9*a* and 9*b* can be suppressed, excessive inflow of electric power to amplifiers 6*a* and 6*b* is prevented, thus preventing amplifiers 6*a* and 6*b* from being damaged. Thus, a loss of the supplied electric power is suppressed, and the radiation efficiency can be enhanced. As a result, highly efficient heating can be achieved.

Figure 3:
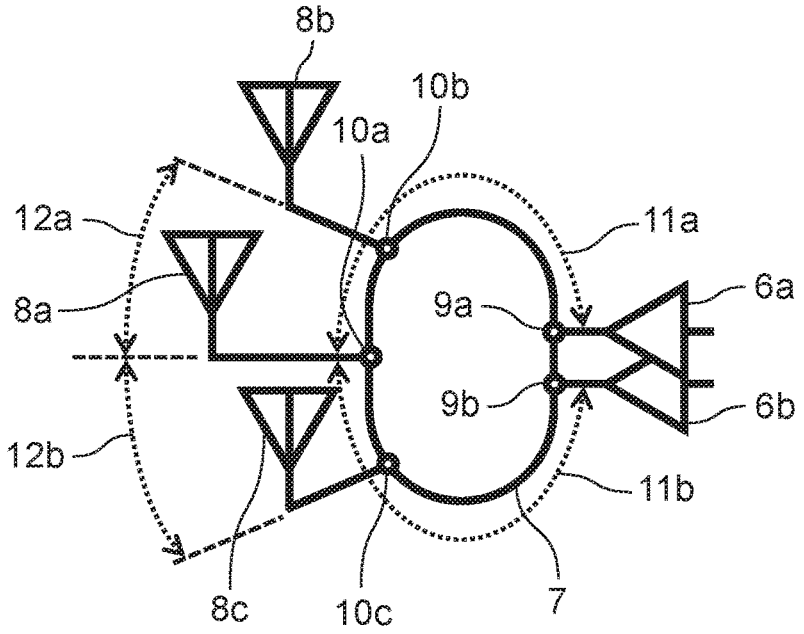
FIG. 3 is a schematic diagram showing a configuration and a line length of the transmission line in the microwave treatment device in accordance with the first exemplary embodiment.

FIG. 3 is a schematic diagram showing a configuration and a line length of transmission line 7 in the microwave treatment device-in accordance with this exemplary embodiment. In particular, FIG. 3 shows a path length between the feeding part and the branch part, and a path length between the branch part and the branch part.

As shown in FIG. 3, a length of transmission line 7 between feeding part 9*a* and branch part 10*a* is set at phase length 11*a*. The length of transmission line 7 between feeding part 9*b* and branch part 10*a* is set at phase length 11*b*. The length of transmission line 7 between branch part 10*a* and branch part 10*b* is set at phase length 12*a*. The length of transmission line 7 between branch part 10*a* and branch part 10*c* is set at phase length 12*b*.

The phase length is a value obtained by substituting the length L (mm) of the transmission line and the wavelength λ (mm) of a microwave propagating through the transmission line into the following equation 1. The unit of the phase length is "degree."

[Math. 1]

$$\text{Phase length [deg.]} = \left(\frac{\text{Length } L \text{ [mm]}}{\text{Wavelength } \lambda \text{ [mm]}} - \text{INT}\left(\frac{\text{Length } L \text{ [mm]}}{\text{Wavelength } \lambda \text{ [mm]}}\right)\right) \times 360$$

(INT function rounds the argument to the nearest integer.)

Phase length 11*a* is set at 0 degrees. Thus, when a microwave propagates through path 11 between feeding part 9*a* and branch part 10*a*, the phase of the microwave after propagation is the same as the phase of the microwave before propagation. Phase length lib is also set at 0 degrees. Thus, when a microwave propagates through path 11 between feeding part 9*b* and branch part 10*a*, the phase of the microwave after propagation is the same as the phase of the microwave before propagation.

Phase length 12*a* is set at 90 degrees. Thus, when a microwave propagates through path 11 between branch part 10*a* and branch part 10*b*, the phase of the microwave after propagation advances by 90 degrees from the phase of the microwave before propagation. Phase length 12*b* is also set at 90 degrees. Thus, when a microwave propagates through path 11 between branch part 10*a* and branch part 10*c*, the phase of the microwave after propagation advances by 90 degrees from the phase of the microwave before propagation.

Table 2 shows an action of transmission line 7 in a case where the microwave amplified by amplifier 6*a* has the same phase as that of the microwave amplified by amplifier 6*b*.

TABLE 2

| Same phase at amplifiers 6a and 6b | From amplifier 6a (=0 [deg.]) | From amplifier 6b (=0 [deg.]) | Synthesizing result |
|---|---|---|---|
| To branch part 10a | +Phase length11a (=0 [deg.]) | +Phase length11b (=0 [deg.]) | Overlap |
| To branch part 10b | +Phase length11a −Phase length12a (=−90 [deg.]) | +Phase length11a +Phase length12a (=90 [deg.]) | Cancel |
| To branch part 10c | +Phase length11a +Phase length12b (=90 [deg.]) | +Phase length11a −Phase length12b (=−90 [deg.]) | Cancel |

The phase length from amplifier 6*a* to feeding part 9*a* and the phase length from amplifier 6*b* to feeding part 9*b* are 0 degrees. Accordingly, the both phase length from amplifier 6*a* to branch part 10*a* and the phase length from amplifier 6*b* to branch part 10*a* are 0 degrees.

Therefore, when the microwave amplified by amplifier 6*a* and the microwave amplified by amplifier 6*b* have the same phase, two microwaves overlap each other and are amplified in branch part 10*a* (see Table 2). As a result, the amplified microwave is supplied to radiation part 8*a*.

Since phase length 12*a* is 90 degrees, the phase length from amplifier 6*a* to branch part 10*b* is decreased by 90 degrees from the phase length (0 degrees) from amplifier 6*a* to branch part 10*a*. On the other hand, the phase length from amplifier 6*b* to branch part 10*b* is increased by 90 degrees from the phase length (0 degrees) from amplifier 6*b* to branch part 10*a*. Therefore, the phase length from amplifier 6*b* to branch part 10*b* is larger by 180 degrees than the phase length from amplifier 6*a* to branch part 10*b*.

Therefore, when the microwave amplified by amplifier 6*a* and the microwave amplified by amplifier 6*b* have the same phase, the two microwaves cancel each other in branch part 10*b* (see Table 2). As a result, a microwave is not supplied to radiation part 8*b*.

Similarly, in branch part 10*c*, two microwaves cancel each other, and a microwave is not supplied to radiation part 8*c*. In this way, when the microwave amplified by amplifier 6*a* and the microwave amplified by amplifier 6*b* have the same phase, high-frequency power is only selectively supplied to radiation part 8*a*.

Table 3 shows actions of transmission line 7 in a case where the microwave amplified by amplifier 6*a* has a phase opposite to that of the microwave amplified by amplifier 6*b*.

TABLE 3

| Opposite phase at amplifier 6a, 6b | From amplifier 6a (0 [deg.]) | From amplifier 6b (180 [deg.]) | Synthesizing result |
|---|---|---|---|
| To branch part 10a | +Phase length11a (=0 [deg.]) | +Phase length11b (=180 [deg.]) | Cancel |
| To branch part 10b | +Phase length11a −Phase length12a (=−90 [deg.]) | +Phase length11a +Phase length12a (=270 [deg.]) | Overlap |
| To branch part 10c | +Phase length11a +Phase length12b (=90 [deg.]) | +Phase length11a −Phase length12b (=90 [deg.]) | Overlap |

When the microwave amplified by amplifier 6*a* and the microwave amplified by amplifier 6*b* have an opposite phase, transmission line 7 acts oppositely to the case shown in Table 2.

That is to say, in branch parts 10*b* and 10*c*, two microwaves overlap each other and are amplified (see Table 3). As a result, the amplified microwaves are supplied to radiation parts 8*b* and 8*c*. In branch part 10*a*, two microwaves cancel each other (see Table 3). As a result, a microwave is not supplied to radiation part 8*a*.

In this way, when the microwave amplified by amplifier 6*a* and the microwave amplified by amplifier 6*b* have an opposite phase, the high-frequency power is selectively supplied to radiation parts 8*b* and 8*c*.

In this exemplary embodiment, a phase difference is controlled between the microwave amplified by amplifier 6*a* and the microwave amplified by amplifier 6*b*, by means of phase variable part 5. Thus, a radiation part that radiates the microwave can be selectively switched among radiation parts 8*a* to 8*c*. As a result, the microwave distribution in heating chamber 1 can be intentionally operated.

Figure 4:
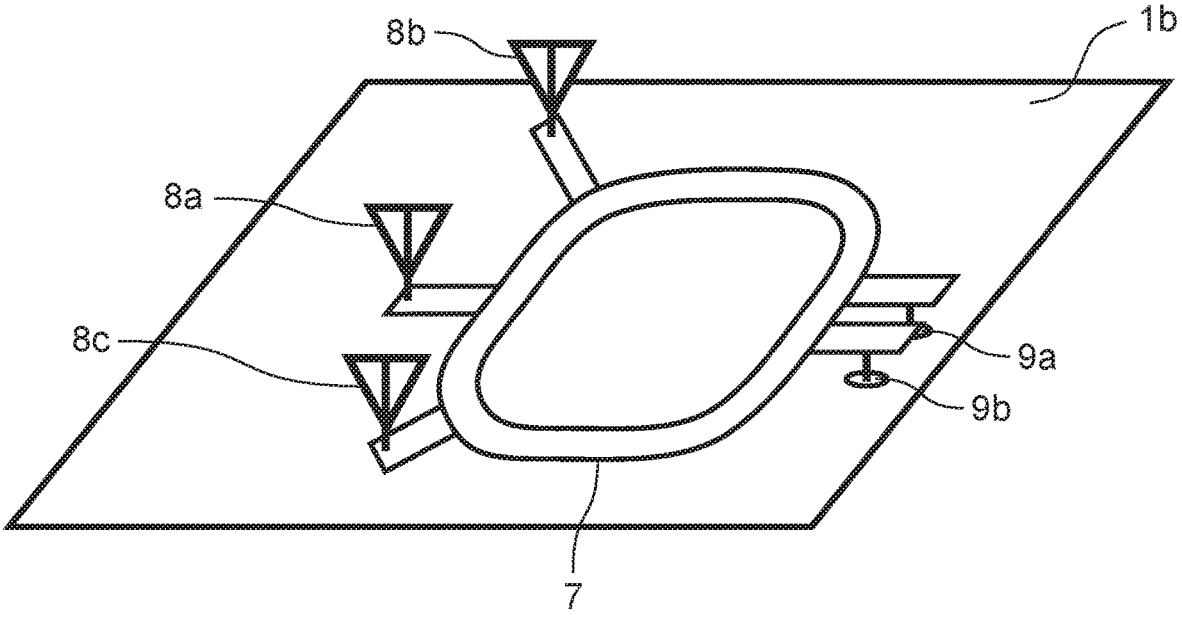
FIG. 4 is a perspective view of the transmission line in the microwave treatment device in accordance with the first exemplary embodiment.

FIG. 4 is a perspective view of transmission line 7 in the microwave treatment device in accordance with this exemplary embodiment. As shown in FIG. 4, transmission line 7 includes a microstrip line that is disposed adjacent to a wall surface of heating chamber 1. Feeding parts 9*a* and 9*b* are formed by connecting coaxial core lines penetrating through wall surface 1*b* of heating chamber 1 to transmission line 7. Branch parts 10*a*, 10*b*, and 10*c* include microstrip lines branched from transmission line 7. Radiation parts 8*a*, 8*b*, and 8*c* are an antenna including a microstrip line.

In this exemplary embodiment, oscillation part 3 include an oscillation source formed of a semiconductor. However, oscillation part 3 may be formed of other oscillation sources such as magnetron.

Second Exemplary Embodiment

Figure 5:
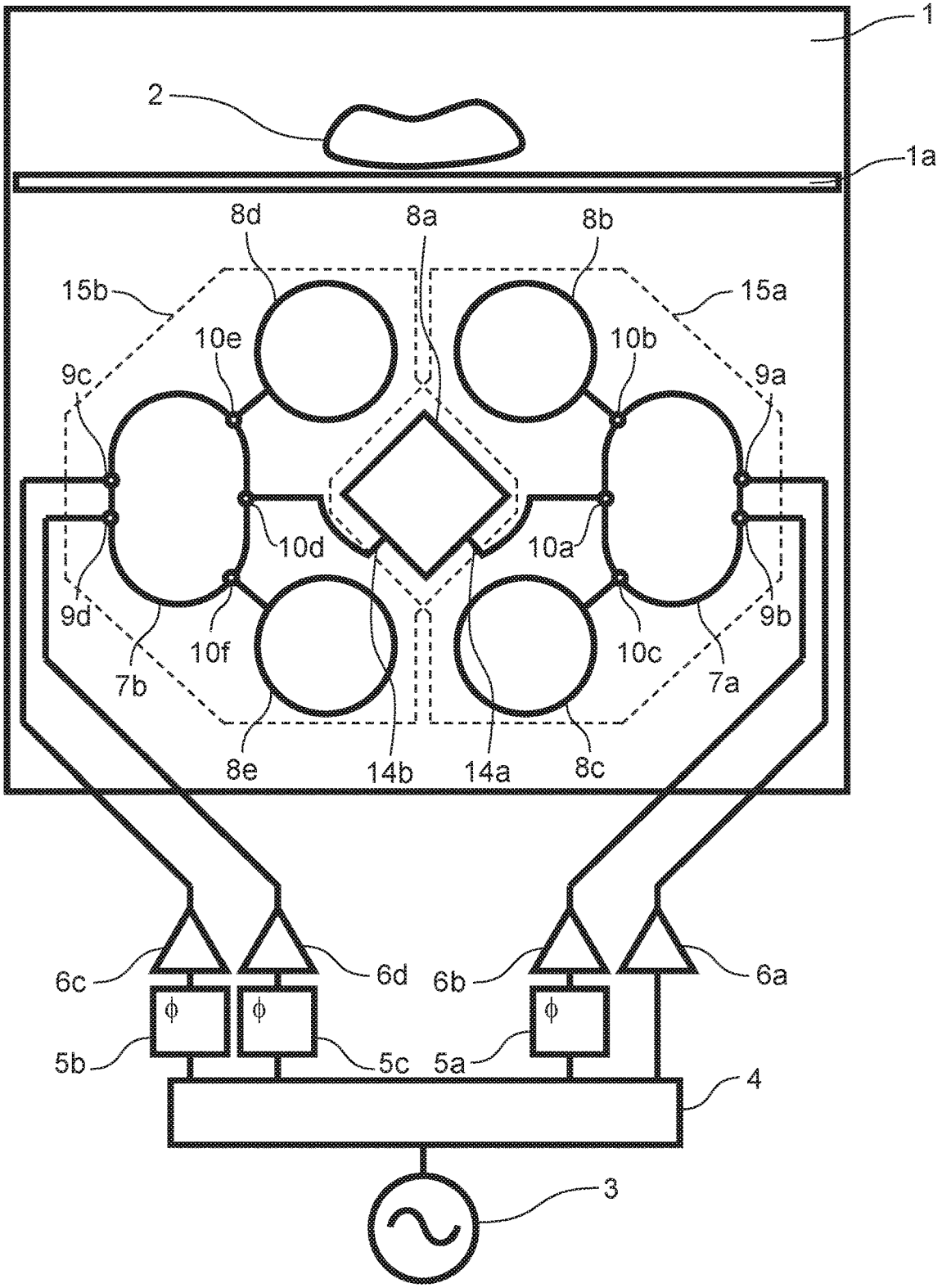
FIG. 5 is a schematic diagram showing a configuration of a transmission line in a microwave treatment device in accordance with a second exemplary embodiment of the present disclosure.

FIG. 5 is a schematic diagram showing a configuration of a transmission line in a microwave treatment device in accordance with a second exemplary embodiment of the present disclosure.

As shown in FIG. 5, the microwave treatment device of this exemplary embodiment includes feeding control circuit 15*a* and feeding control circuit 15*b*. Feeding control circuits 15*a* and 15*b* are respectively arranged at the right side and left side below mount table 1*a* of heating chamber 1.

Feeding control circuit 15*a* includes feeding part 9*a*, feeding part 9*b*, transmission line 7*a*, radiation part 8*a*, radiation part 8*b*, and radiation part 8*c*. Feeding control circuit 15*b* includes feeding part 9*c*, feeding part 9*d*, transmission line 7*b* having a loop line structure, radiation part 8*a*, radiation part 8*d*, and radiation part 8*e*.

Feeding control circuits 15*a* and 15*b* share radiation part 8*a*, and both feeding control circuits 15*a* and 15*b* can transmit a microwave to radiation part 8*a*. Radiation part 8*a* is disposed below the center of mount table 1*a*.

Transmission lines 7*a* and 7*b* have an elliptical loop line structure including a straight portion and a curved portion similar to transmission line 7 of the first exemplary embodiment. Feeding parts 9*a* and 9*b* are arranged in the straight portion of transmission line 7*a*. Feeding parts 9*c* and 9*d* are arranged in the straight portion of transmission line 7*b*.

Distributing part 4 distributes microwaves generated by oscillation part 3 into four, and supplies the distributed microwaves to phase variable parts 5*a*, 5*b*, and 5*c* and amplifier 6*a*. Phase variable parts 5*a*, 5*b*, and 5*c* change the phases of the microwaves distributed by distributing part 4.

Amplifier 6*a* amplifies the microwaves distributed by distributing part 4. Amplifier 6*b* amplifies the microwaves whose phase has been changed by phase variable part 5*a*. Amplifier 6*c* amplifies the microwaves whose phase has been changed by phase variable part 5*b*. Amplifier 6*d* amplifies the microwaves whose phase has been changed by phase variable part 5*c*.

The microwave amplified by amplifier 6*a* is transmitted to transmission line 7*a* via feeding part 9*a*. The microwave amplified by amplifier 6*b* is transmitted to transmission line 7*a* via feeding part 9*b*. The microwave amplified by amplifier 6*c* is transmitted to transmission line 7*b* via feeding part 9*c*. The microwave amplified by amplifier 6*d* is transmitted to transmission line 7*b* via feeding part 9*d*.

Branch part 10*a*, branch part 10*b*, and branch part 10*c* are arranged in the straight portion of transmission line 7*a*. Branch part 10*d*, branch part 10*e*, and branch part 10*f* are arranged in the straight portion of transmission line 7*b*.

Microwaves transmitted to transmission line 7*a* via feeding parts 9*a* and 9*b* are synthesized on transmission line 7*a*. The microwaves synthesized on transmission line 7*a* are supplied to radiation parts 8*a*, 8*b*, and 8*c* via branch parts 10*a*, 10*b*, and 10*c*.

Microwaves transmitted to transmission line 7*b* via feeding parts 9*c* and 9*d* are synthesized on transmission line 7*b*. The microwaves synthesized on transmission line 7*b* are supplied to radiation parts 8*a*, 8*d*, and 8*e* via branch parts 10*d*, 10*e*, and 10*f*.

In this exemplary embodiment, radiation parts 8*a*, 8*b*, and 8*c* correspond to the first radiation part, the second radiation part, and the third radiation part in feeding control circuit 15*a*, respectively. Feeding parts 9*a* and 9*b* correspond to the first radiation part and the second radiation part in feeding control circuit 15*a*, respectively. Branch parts 10*a*, 10*b*, and 10*c* correspond to the first branch part, the second branch part, and the third branch part in feeding control circuit 15*a*, respectively.

Radiation parts 8*a*, 8*d*, and 8*e* correspond to the first radiation part, the second radiation part, and the third radiation part in feeding control circuit 15*b*, respectively. Feeding parts 9*c* and 9*d* correspond to the first feeding part and the second feeding part in feeding control circuit 15*b*, respectively. Branch parts 10*d*, 10*e*, and 10*f* correspond to the first branch part, the second branch part, and the third branch part in feeding control circuit 15*b*, respectively.

That is to say, the first radiation part in feeding control circuit 15*a* is common to the first radiation part in feeding control circuit 15*b*.

Radiation parts 8*a* to 8*e* are a patch antenna. Radiation part 8*a* has a square shape. Radiation part 8*a* has feeding part 14*a* and feeding part 14*b*, each of which is arranged to a corresponding one of neighboring two sides. Feeding parts 14*a* and 14*b* transmit a microwave vertically with respect to radiation part 8*a*.

With this configuration, two microwaves transmitted to radiation part 8*a* have excitation directions orthogonal to each other, and do not interfere with each other. This can suppress penetration of microwaves between feeding control circuits 15*a* and 15*b*.

Note here that although not shown exactly in FIG. 5, radiation parts 8*a* to 8*c* are arranged in parallel to mount table 1*a*.

In this exemplary embodiment, a phase difference is controlled between the microwave amplified by amplifier 6*a* and the microwave amplified by amplifier 6*b*, by means of phase variable part 5*a*. Thus, a radiation part that radiates the microwave can be selectively switched among radiation parts 8*a*, 8*b*, and 8*c*. As a result, the microwave distribution at the right side in heating chamber 1 can be intentionally operated.

A phase difference is controlled between the microwave amplified by amplifier 6*c* and the microwave amplified by amplifier 6*d*, by means of phase variable parts 5*b* and 5*c*. Thus, a radiation part that radiates the microwave can be selectively switched among radiation parts 8*a*, 8*d*, and 8*e*. As a result, the microwave distribution at the left side in heating chamber 1 can be intentionally operated.

Furthermore, by means of phase variable parts 5*b* and 5*c*, the phase of the microwaves amplified by amplifiers 6*c* and 6*d* can be made to be different from the phase of the microwaves amplified by amplifiers 6*a* and 6*b*.

Third Exemplary Embodiment

Next, a microwave treatment device in accordance with a third exemplary embodiment of the present disclosure is described. The microwave treatment device of this exemplary embodiment has substantially the same configurations as those of the first exemplary embodiment shown in FIGS. 1 to 3.

This exemplary embodiment is different from the first exemplary embodiment in that path 13 in transmission line 7, that is, an interval between feeding parts 9*a* and 9*b*, has a length of ¼ of the wavelength of the microwave. Hereinafter, with reference to FIG. 2, the microwave treatment device of this exemplary embodiment is described.

Table 4 shows actions of transmission line 7 in a case where the microwave amplified by amplifier 6*a* has the same phase as that of the microwave amplified by amplifier 6*b*.

TABLE 4

| Same phase at amplifiers 6a and 6b | From amplifier 6a (=0 [deg.]) | From amplifier 6b (=0 [deg.]) | Synthesizing result |
|---|---|---|---|
| To feeding part 9a | (0 [deg.]) | +Phase length13a (=90 [deg.]) | Overlap |
| To feeding part 9b | +Phase length13a (=90 [deg.]) | (0 [deg.]) | Overlap |

Since the length of path 13 is ¼ of the wavelength of the microwave, phase length 13*a* of path 13 is 90 degrees. As described above, the phase length from amplifier 6*a* to feeding part 9*a* and the phase length from amplifier 6*b* to feeding part 9*b* are 0 degrees.

Therefore, as shown in Table 4, the phase of the microwave from amplifier 6*b* advances by 90 degrees at feeding part 9*a* via path 13. The microwave from amplifier 6*b* is synthesized with the microwave from amplifier 6*a* in power feeding section 9*a*. The microwaves synthesized at power feeding section 9*a* propagate counterclockwise on path 11.

Similarly, the phase from amplifier 6*a* advances by 90 degrees at feeding part 9*b* via path 13. The microwaves from amplifier 6*a* is synthesized with the microwave from amplifier 6*b* at feeding part 9*b*. The microwaves synthesized at feeding part 9*b* propagates clockwise on path 11. Thus, when amplifiers 6*a* and 6*b* supply microwaves having the same phase, two equal microwaves are transmitted from feeding parts 9*a* and 9*b* to path 11.

Table 5 shows actions of transmission line 7 in a case where the microwave amplified by amplifier 6*b* has a phase that advances by 90 degrees with respect to the microwave amplified by amplifier 6*a*.

TABLE 5

| Phase difference of 90 deg. at amplifiers 6a and 6b | From amplifier 6a (0 [deg.]) | From amplifier 6b (90 [deg.]) | Synthesizing result |
|---|---|---|---|
| To feeding part 9a | (0 [deg.]) | +Phase length13a (=180 [deg.]) | Cancel |
| To feeding part 9b | +Phase length13a (=90 [deg.]) | (90 [deg.]) | Overlap |

As shown in Table 5, the phase of the microwave from amplifier 6*b* advances by 90 degrees at feeding part 9*a* via path 13. Therefore, at feeding part 9*a*, the microwave from amplifier 6*b* has a phase opposite to that of the microwave from amplifier 6*a*. As a result, these microwaves are synthesized at feeding part 9*a* and cancel each other, and does not propagate on path 11.

On the other hand, the phase of the microwave from amplifier 6*a* advances by 90 degrees at feeding part 9*b* via path 13. Therefore, at feeding part 9*b*, the microwave from amplifier 6*a* has the same phase as that of the microwave from amplifier 6*b*. As a result, these microwaves overlap each other and are amplified at feeding part 9*b*. The microwaves synthesized at feeding part 9*b* propagate clockwise on path 11.

In this way, when the microwave amplified by amplifier 6*b* has a phase that advances by 90 degrees with respect to the microwave amplified by amplifier 6*a*, the amplified microwave propagates clockwise from feeding part 9*b* clockwise on path 11. This microwave is mainly supplied to radiation part 8*c* that is the closest from feeding part 9*b*.

Table 6 shows actions of transmission line 7 in a case where the microwave amplified by amplifier 6*b* has a phase that delays from the microwave amplified by amplifier 6*a*.

TABLE 6

| Phase difference of 90 deg. at amplifiers 6a and 6b | From amplifier 6a (0 [deg.]) | From amplifier 6b (−90 [deg.]) | Synthesizing result |
|---|---|---|---|
| To feeding part 9a | (0 [deg.]) | +Phase length13a (=0 [deg.]) | Overlap |

TABLE 6-continued

| Phase difference of 90 deg. at amplifiers 6a and 6b | From amplifier 6a (0 [deg.]) | From amplifier 6b (−90 [deg.]) | Synthesizing result |
|---|---|---|---|
| To feeding part 9b | +Phase length13a (=90 [deg.]) | (−90 [deg.]) | Cancel |

As shown in Table 6, the phase of the microwave from amplifier 6*b* advances by 90 degrees at feeding part 9*a* via path 13. Therefore, at feeding part 9*a*, the microwave from amplifier 6*b* has the same phase as that of the microwave from amplifier 6*a*. As a result, these microwaves overlap each other and amplified at feeding part 9*a*. The microwaves synthesized at feeding part 9*a* propagate counterclockwise on path 11.

On the other hand, the phase of the microwave from amplifier 6*a* advances by 90 degrees at feeding part 9*b* via path 13. Therefore, at feeding part 6*b*, the microwave from amplifier 6*a* has a phase opposite to that of the microwave from amplifier 6*b*. As a result, these microwaves are synthesized at feeding part 9*b* and cancel each other, and does not propagates on path 11.

In this way, when the microwave amplified by amplifier 6*b* has a phase that is delayed by 90 degrees with respect to the microwave amplified by amplifier 6*a*, the amplified microwave propagates counterclockwise from feeding part 9*a* on path 11. This microwave is mainly supplied to radiation part 8*b* closest to feeding part 9*a*.

Fourth Exemplary Embodiment

Figure 6:
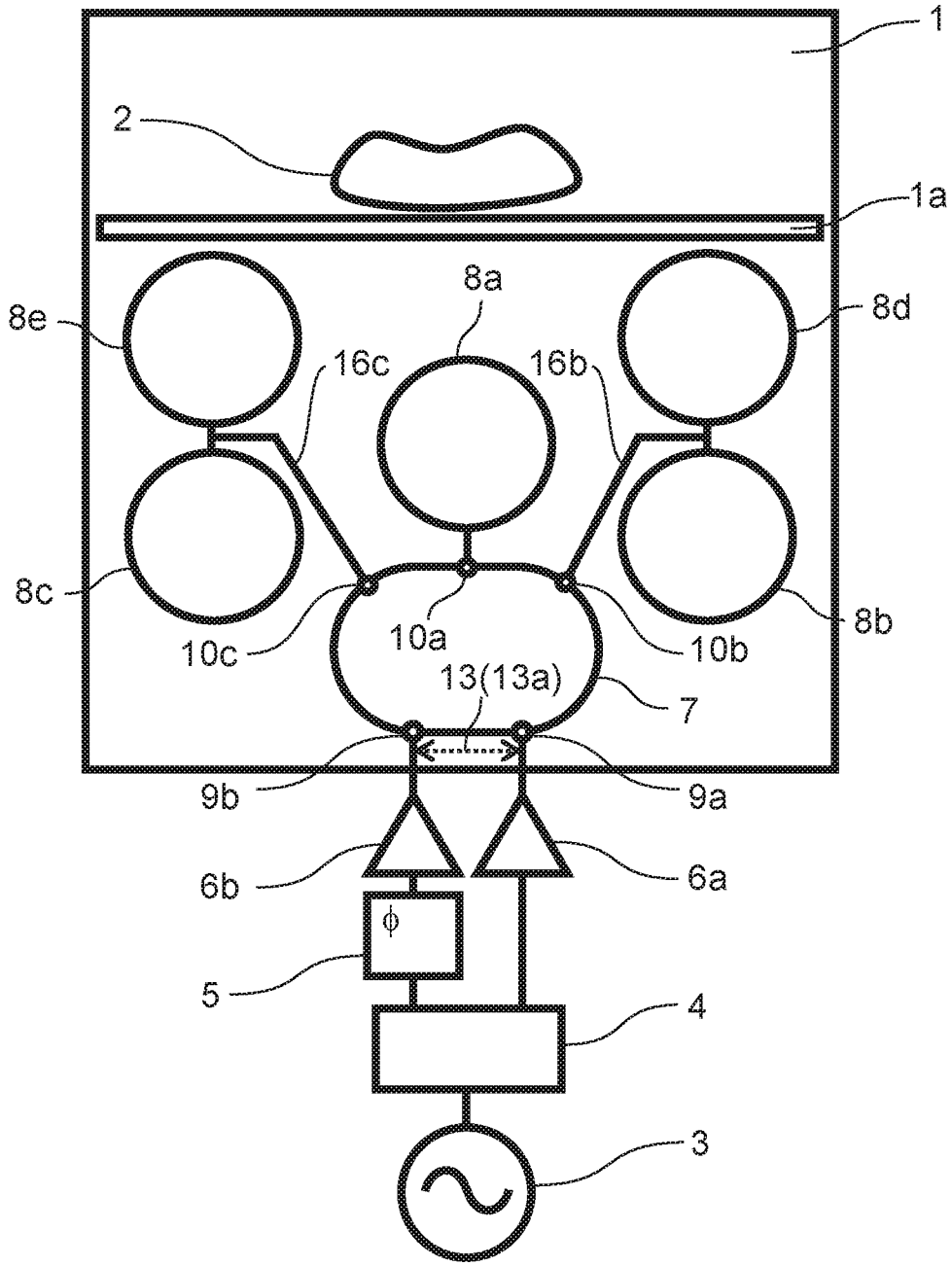
FIG. 6 is a schematic diagram showing a configuration of a transmission line in a microwave treatment device in accordance with a fourth exemplary embodiment of the present disclosure.

FIG. 6 is a schematic diagram showing a configuration of transmission line 7 in a microwave treatment device in accordance with a fourth exemplary embodiment of the present disclosure.

As shown in FIG. 6, the microwave treatment device of this exemplary embodiment includes transmission line 7 and radiation parts 8*a*, 8*b*, 8*c*, 8*d*, and 8*e*, which are arranged below mount table 1*a* of heating chamber 1. Radiation part 8*a* is disposed in the center portion. Radiation parts 8*b* and 8*d* are arranged at right side. Radiation parts 8*c* and 8*e* are arranged at left side. Radiation parts 8*a* to 8*e* are a patch antenna.

Radiation part 8*a* is connected to branch part 10*a* of transmission line 7. Transmission line 16*b* branched into two is connected to branch part 10*b* of transmission line 7. Each of radiation part 8*b* and radiation part 8*d* is connected to the corresponding one of two branched portions of transmission line 16*b*. Transmission line 16*c* branched into two is connected to branch part 10*c* of transmission line 7. Each of radiation part 8*c* and radiation part 8*e* is connected to the corresponding one of two branched portions of transmission line 16*c*.

In this exemplary embodiment, radiation part 8*a* corresponds to the first radiation part. Radiation parts 8*b* and 8*d* correspond to the second radiation part. Radiation parts 8*c* and 8*e* correspond to the third radiation part. That is to say, the second radiation part and the third radiation part include a plurality of radiation parts.

Note here that although not exactly shown in FIG. 6, radiation parts 8*a* to 8*d* are arranged in parallel to mount table 1*a*.

In this exemplary embodiment, similar to the third exemplary embodiment, a length of path 13 in transmission line 7, that is, the interval between feeding parts 9*a* and 9*b* is ¼ of the wavelength of the microwave. Phase length 13*a* of path 13 is 90 degrees.

Therefore, when microwave amplified by amplifier 6*b* has a phase that advances by 90 degrees with respect to the microwave amplified by amplifier 6*a* (see Table 5 in the third exemplary embodiment), the microwaves overlapped and amplified are mainly supplied to radiation parts 8*c* and 8*e*. As a result, heating target object 2 placed in the vicinity of radiation parts 8*c* and 8*e* is strongly heated.

When the microwave amplified by amplifier 6*b* has a phase that delays by 90 degrees with respect to the microwave amplified by amplifier 6*a* (see Table 6 in the third exemplary embodiment), the microwaves overlapped and amplified are mainly supplied to radiation parts 8*b* and 8*d*. As a result, heating target object 2 placed in the vicinity of radiation parts 8*b* and 8*d* is strongly heated.

According to this exemplary embodiment, a phase difference is controlled similar to that in the third exemplary embodiment, the intended wide range of heating distribution can be achieved. As a result, heat objects to be heated having different shapes, types, and amounts can be heated for a short time in a desired state.

INDUSTRIAL APPLICABILITY

As mentioned above, the microwave treatment device in accordance with the present disclosure can select a radiation part that radiates a microwave among a plurality of radiation parts while penetration of microwave in a plurality of feeding parts is suppressed. Thus, heating efficiency can be improved and the intended heating distribution can be achieved. The present disclosure can be applied to a high-frequency power supply used in a heating device using dielectric heating, a garbage disposer, a plasma generation power supply which is a semiconductor manufacturing device, and the like.

REFERENCE MARKS IN THE DRAWINGS

1 heating chamber
1*a* mount table
1*b* wall surface
2 heating target object
3 oscillation part
4 distributing part
5, 5*a*, 5*b*, 5*c* phase variable part
6*a*, 6*b*, 6*c*, 6*d* amplifier
7, 7*a*, 7*b*, 16*b*, 16*c* transmission line
8*a*, 8*b*, 8*c*, 8*d*, 8*e* radiation part
9*a*, 9*b*, 9*c*, 9*d*, 14*a*, 14*b* feeding part
10*a*, 10*b*, 10*c*, 10*d*, 10*e*, 10*f* branch part
11, 13 path
11*a*, 11*b*, 12*a*, 12*b*, 13*a* phase length
15*a*, 15*b* feeding control circuit

The invention claimed is:

1. A microwave treatment device comprising:

a plurality of radiation parts including a first radiation part, a second radiation part, and a third radiation part, and configured to radiate a microwave;

a transmission line having a loop line structure including a plurality of branch parts, the plurality of branch parts including a first branch part, a second branch part, and a third branch part, the transmission line configured to transmit the microwave to the first radiation part, the second radiation part, and the third radiation part respectively connected to the first branch part, the second branch part, and the third branch part; and a plurality of feeding parts including a first feeding part and a second feeding part arranged in the transmission line at an interval of ¼ or less of a wavelength of the microwave, and configured to transmit the microwave to the transmission line.

2. The microwave treatment device according to claim 1, wherein the first branch part is arranged at an equal interval from the first feeding part and the second feeding part, and the second branch part and the third branch part are separately arranged apart at ¼ of the wavelength from the first branch part.

3. The microwave treatment device according to claim 1, wherein each of the first feeding part and the second feeding part is configured to transmit the microwave vertically with respect to the transmission line.

4. The microwave treatment device according to claim 1, wherein a radiation part that radiates the microwave is selectively switched among the plurality of radiation parts by controlling a phase difference between two microwaves supplied from the first feeding part and the second feeding part to the transmission line.

5. The microwave treatment device according to claim 1, wherein the first feeding part and the second feeding part are arranged at an interval of ¼ of the wavelength.

6. The microwave treatment device according to claim 1, wherein a length of one circumference of the transmission line is set at a sum of an integral multiple of the wavelength, a half of the wavelength, and twice of the interval between the first feeding part and the second feeding part.

7. The microwave treatment device according to claim 1, wherein the transmission line has an elliptical shape including a straight portion and a curved portion.

8. The microwave treatment device according to claim 1, comprising a first feeding control circuit and a second feeding control circuit, wherein each of the first feeding control circuit and the second feeding control circuit includes the plurality of feeding parts, the plurality of branch parts, the plurality of radiation parts, and the transmission line, and the first radiation part included in the first feeding control circuit is common to the first radiation part included in the second feeding control circuit.

9. The microwave treatment device according to claim 8, further comprising a heating chamber configured to accommodate a heating target object, wherein the first radiation part is disposed below a center portion of a mount table of the heating chamber.

10. The microwave treatment device according to claim 8, wherein the first radiation part is a patch antenna, and each of the first feeding control circuit and the second feeding control circuit is configured to transmit the microwave vertically with respect to the first radiation part.

11. The microwave treatment device according to claim 1, wherein the second radiation part includes a plurality of radiation parts, and the third radiation part includes a plurality of radiation parts.

* * * * *